US006217238B1

(12) United States Patent
Mastrodicasa et al.

(10) Patent No.: US 6,217,238 B1
(45) Date of Patent: Apr. 17, 2001

(54) PHOTOGRAPHIC FILM PROCESSOR AND METHOD OF DEVELOPING FILM

(75) Inventors: Nando Alfonso Mastrodicasa, Woodbridge; David Bradley Marett, Toronto, both of (CA)

(73) Assignee: Phototrader, Inc., Concord (CA)

( * ) Notice: Subject to any disclaimer, the term of this patent is extended or adjusted under 35 U.S.C. 154(b) by 0 days.

(21) Appl. No.: 09/250,604

(22) Filed: Feb. 17, 1999

(51) Int. Cl.[7] ..... G03D 3/08; G03D 3/02

(52) U.S. Cl. ..... 396/572; 396/571; 396/618; 396/620; 396/622; 396/626

(58) Field of Search ..... 396/571, 572, 396/617, 618, 620, 622, 614, 626

(56) References Cited

U.S. PATENT DOCUMENTS

| | | | | |
|---|---|---|---|---|
| 3,943,539 | * | 3/1976 | Bown | 396/617 |
| 4,613,221 | | 9/1986 | Takase et al. . | |
| 4,736,222 | | 4/1988 | Stromberg . | |
| 4,775,873 | | 10/1988 | Blackman et al. . | |
| 4,929,976 | * | 5/1990 | Cunningham et al. | 396/618 |
| 5,281,989 | * | 1/1994 | Sitte | 396/620 |
| 5,526,087 | * | 6/1996 | Suzuki et al. | 396/571 |
| 5,627,619 | * | 5/1997 | Kimura et al. | 396/620 |
| 5,629,751 | * | 5/1997 | Tsumura et al. | 396/622 |

OTHER PUBLICATIONS

Konica "Film Processor CL–FP34E, Parts List," Konica Nice Print System.

Eastman Kodak Company, "Site Specifications for the Kodak Minilab System 40," Publication No. XP2274–2, Mar. 1986.

Eastman Kodak Company, "Parts List For the Kodak Film Processor, System 75," Publication No. XP2341–2, Jan. 1988 (Supersedes XP2341–1, May 1987).

COPAL "Foto First FF–5CII, CFP–522," Parts List.

* cited by examiner

*Primary Examiner*—Alan A. Mathews
(74) *Attorney, Agent, or Firm*—Nixon & Vanderhye P.C.

(57) ABSTRACT

A compact and energy efficient apparatus for processing and drying an elongated strip of photographic film having a succession of film processing tanks containing selected processing liquids; drive system which advances the film strip endwise through the tanks to selected depths in liquids corresponding to required exposure times of the film to the different liquids while reducing the tank to tank contamination caused by the transport of treatment of liquids from tank to tank, and a heater system which reuses the waste heat generated by the mechanical and electrical components of the apparatus to dry the film strip as it emerges from the successive processing tanks.

7 Claims, 10 Drawing Sheets

PHOTOGRAPHIC FILM PROCESSOR AND METHOD OF DEVELOPING FILM

BACKGROUND AND SUMMARY OF THE INVENTION

This invention relates generally to photographic film processing, and more particularly to a compact, energy efficient apparatus and a method for processing such film.

Processing of film, requires chemically treating the film followed by rinsing and drying. The chemical treatment typically involves the application of a series of specific chemical agents, in a specific order, with the film being exposed to each treating chemical for minimum amounts of time. To obtain this processing, the film being treated is typically passed through a series of treatment tanks and into the dryer area. One such prior art device is disclosed in U.S. Pat. No. 4,613,221 to Takase et al., issued Sep. 23, 1986.

But the known prior art devices suffer two principle disadvantages: 1) the exposure requirements of certain treating chemicals, such as the developing solution, require relatively large treatment tanks, and 2) the drying process requires enormous amounts of energy. As a result, the known film processing devices are large and cumbersome, and are also extremely expensive to use due to high energy consumption. The known prior art also either requires the use of custom, proprietary drive belts which are costly to replace, or a multiplicity of gears and drive shafts which undesirably increase maintenance costs. Finally, the known film processing equipment either requires separate additional drive mechanisms or undesirably permits significant amounts of the treating chemicals to be transferred, either by the drive mechanism or the film being processed, to subsequent treatment tanks thereby increasing the consumption of the treating chemicals and causing contamination of the treating chemicals found in subsequent tanks.

There is need for a compact and energy efficient apparatus of the present invention, which enables rapid and energy efficient automatic processing of photographic film, as during its exposure to different liquids or solutions, prior to a final drying stage which uses standard drive belts to move the film through the processing equipment and which minimizes cross-tank contamination caused when the film carries treatment chemicals to subsequent treatment tanks.

SUMMARY OF THE INVENTION

It is a major object of the invention to provide improved energy efficient apparatus and method, meeting the above needs. Basically, the improved apparatus comprises:

a) receptacle means having a succession of short, low volume processing tanks containing liquids, b) efficient drive means for advancing the film strip endwise through those tanks and to selected depths in the liquids corresponding to required exposure times of the film to the different solutions, c) precise and efficient heating means for warning solutions to process temperature, d) means for employing waste heat generated by control circuitry, power supply, circulation means, and heating means to supplement the dryer heater in evaporating residual solution from the film strips as they pass through the drying zone, e) control means and power supply to efficiently deliver power to said heating, driving and circulating means.

It is another object to provide an apparatus wherein the heating means includes heaters located outside the film processing zones, and a waste heat recovery system having an air flow passage which channels the air heated by waste heat generated by the solution heaters, circulation pumps, control circuitry and power supply toward a film strip drying zone. At least one of the heaters may typically include a heating element exposed to the air flow passage, there being a duct for circulating processing liquid in heat transfer relation with that element, and toward one of the processing zones. Multiple such elements such as electrical coils may be employed for heating processing liquids circulating in heat transfer relation with the respective elements while flowing toward the respective processing zones.

A further object is to provide one or more pumps located in series with the duct or ducts, to pump processing liquid for circulation to the receptacle tanks. Such pumps, heating elements and ducts may be compactly located at one side of the receptacle means, the air flow passage being located at that side of the receptacle means, whereby air flowing through the passage contacts the heaters and pumps in series sequence.

Yet another object is to provide electrical control circuitry to control pumps, drive system and heaters, such circuitry generating heat, and the air flow passage extending in such proximate relation to that circuitry that generated heat is transferred to air flowing in said passage, toward the drying zone to assist in the film drying process.

An additional object is to provide the receptacle means to define a series of tanks to receive film processing liquid, and removable racks received in the tanks, the drive means extending into the racks to drive the film strips downwardly and upwardly in the respective racks. The racks typically have associated rotors and guides to direct a leader card with attached film strips downwardly and upwardly therein. Further, the leader card engaging rotors associated with one rack include lower and upper rotors, with longer racks employing a third mid-way rotor, to direct the leader card sequentially downwardly and upwardly within that rack. Drive may be transmitted to lower rotors from upper rotors utilizing a pulley associated with each rotor, said pulley engaging a timing belt to transmit drive, whereby only one main drive shaft is required per belt. The leader card with attached film strips may be entrained by a sprocket associated with each rotor. In at least one of the racks, the films are directed downwardly and upwardly twice each so that longer exposure to processing fluid will be obtained within a shallower tank. Means are provided to direct said leader card and films from an entrance area to said racks and from said racks to the exit.

A further object of the present invention is the reduction of the amount of treating solution which is undesirably carried from one treatment tank to the next.

The method of the invention basically includes:

a) providing receptacle means having a succession of film processing tanks containing different processing liquids to contact the endwise traveling film strips, b) advancing the film strips endwise through those tanks and to selected depths in the liquids corresponding to required exposure times of the film to the different liquids, c) heating the liquids in different tanks to selected processing temperatures, d) employing waste heat generated in said apparatus to supplement heating means for film drying, e) and a control circuit and power supply which advantageously employ low voltage direct current to unpart power to the heating elements.

These and other objects and advantages of the invention, as well as the details of an illustrative embodiment, will be more fully understood from the following specification and drawings, in which:

DETAILED DESCRIPTION OF THE PREFERRED EMBODIMENT

I. General Description

Figure 11:
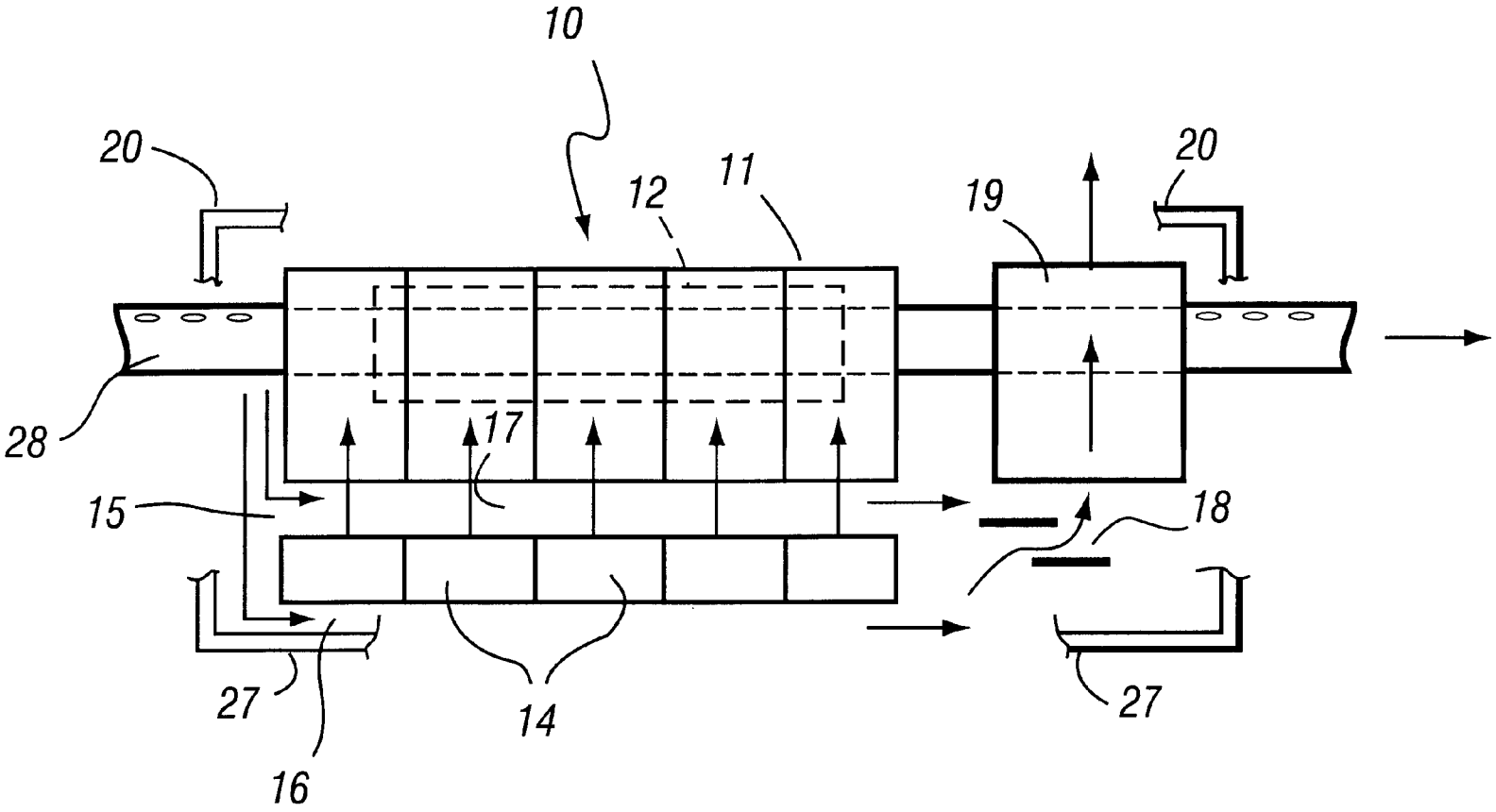
FIG. 11 is a schematic view of the apparatus of the present invention illustrating the waste heat air passage.

FIG. 11 shows, in schematic form, an apparatus for processing and drying an elongated strip 28 of photographic film which has been exposed and requires development. As shown, such apparatus comprises a) receptacle means such as a receptacle 10 having a succession of film processing tanks 11 containing various processing liquids, b) drive means as for example a drive 12 for advancing the film strip 28 endwise through such tanks and to selected depths in the liquids corresponding to required exposure times of the film to the different liquids, c) heating means, as for example one or more heaters 14, for heating the liquids to selected temperature or temperatures, d) and additional means, such as air flow paths 15–18 and heat transfer or drying zone 19, for air drying the film strip, after it has passed through the liquids in the processing tanks.

A housing for the apparatus appears at 20. The above schematic showing of the invention is considered as one preferred embodiment.

II. Detailed Description

Figure 1:
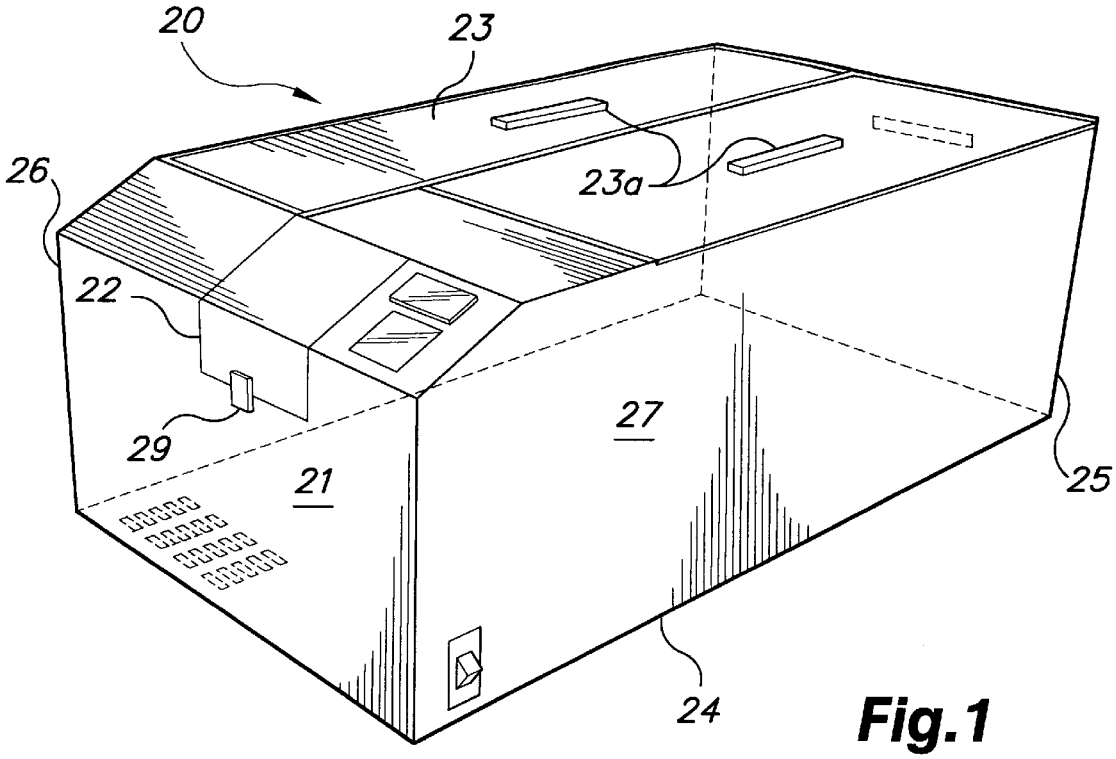
FIG. 1 is a perspective view of a container or housing for apparatus incorporating the invention.
Figure 2:
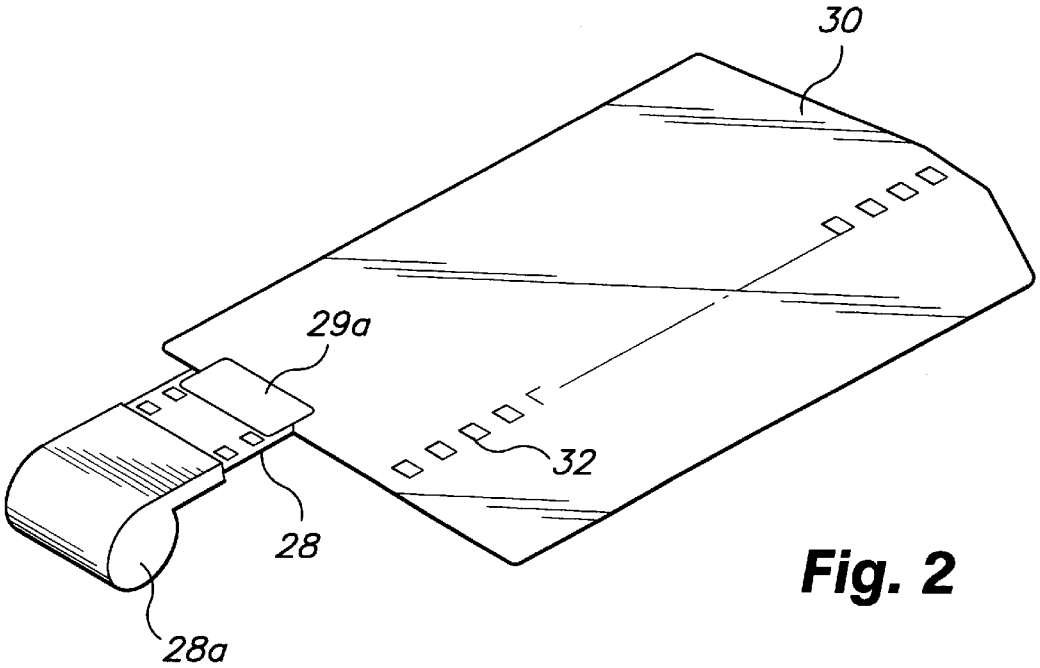
FIG. 2 is a perspective view of a film strip being pulled from a supply cassette, by a leader card that advances through the processing apparatus.
Figure 3:
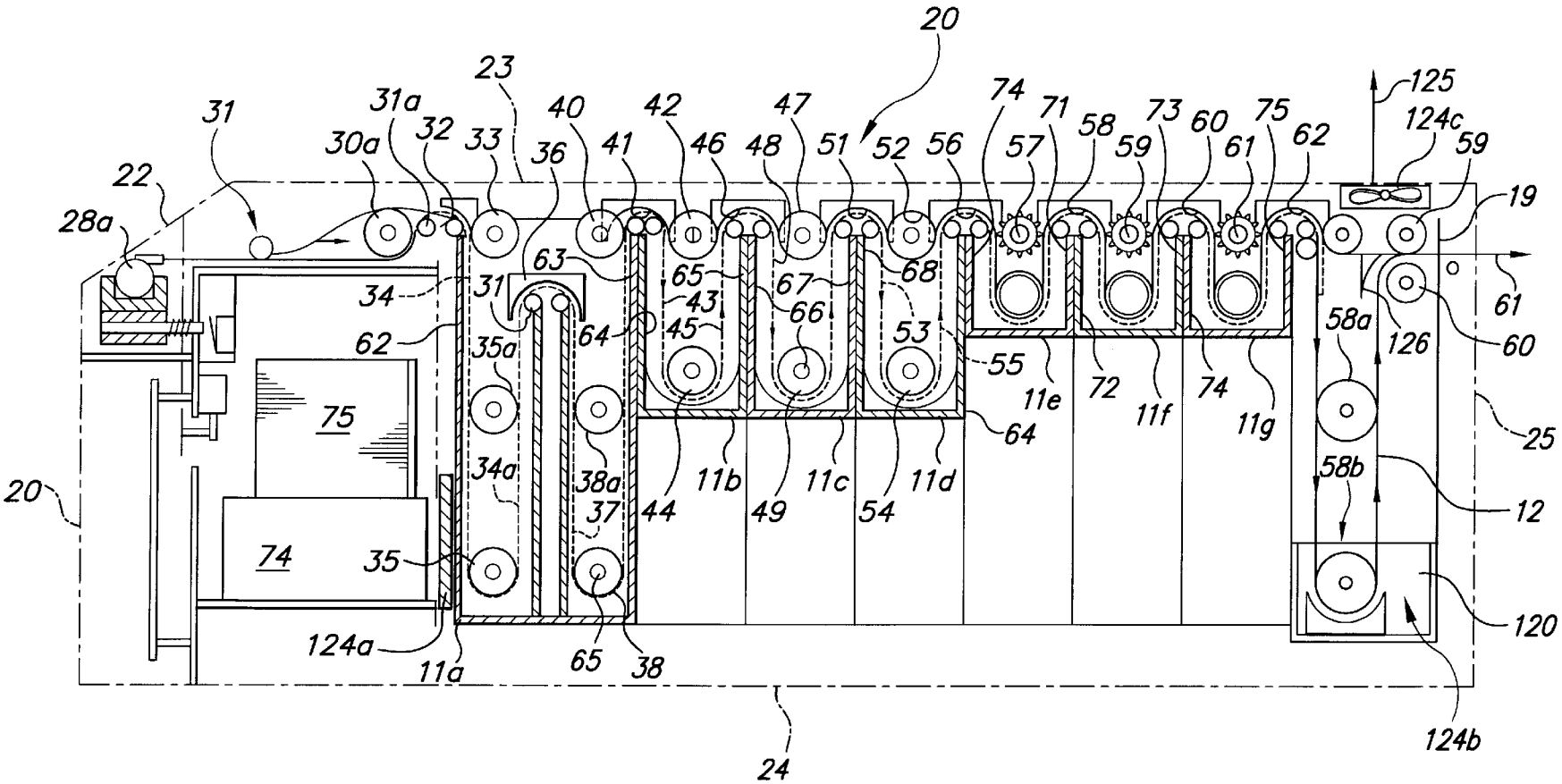
FIG. 3 is a schematic side elevation of the processing apparatus, showing a sequence of processing tanks, and the film paths through the successive tanks.

Extending the description to FIGS. 1–3, the housing 20 includes a front end wall 21 having a loading door 22, top and bottom walls 23 and 24, rear end wall 25, and opposite side walls 26 and 27. A latch 29 releasably holds the loading door in closed position.

Figure 10:
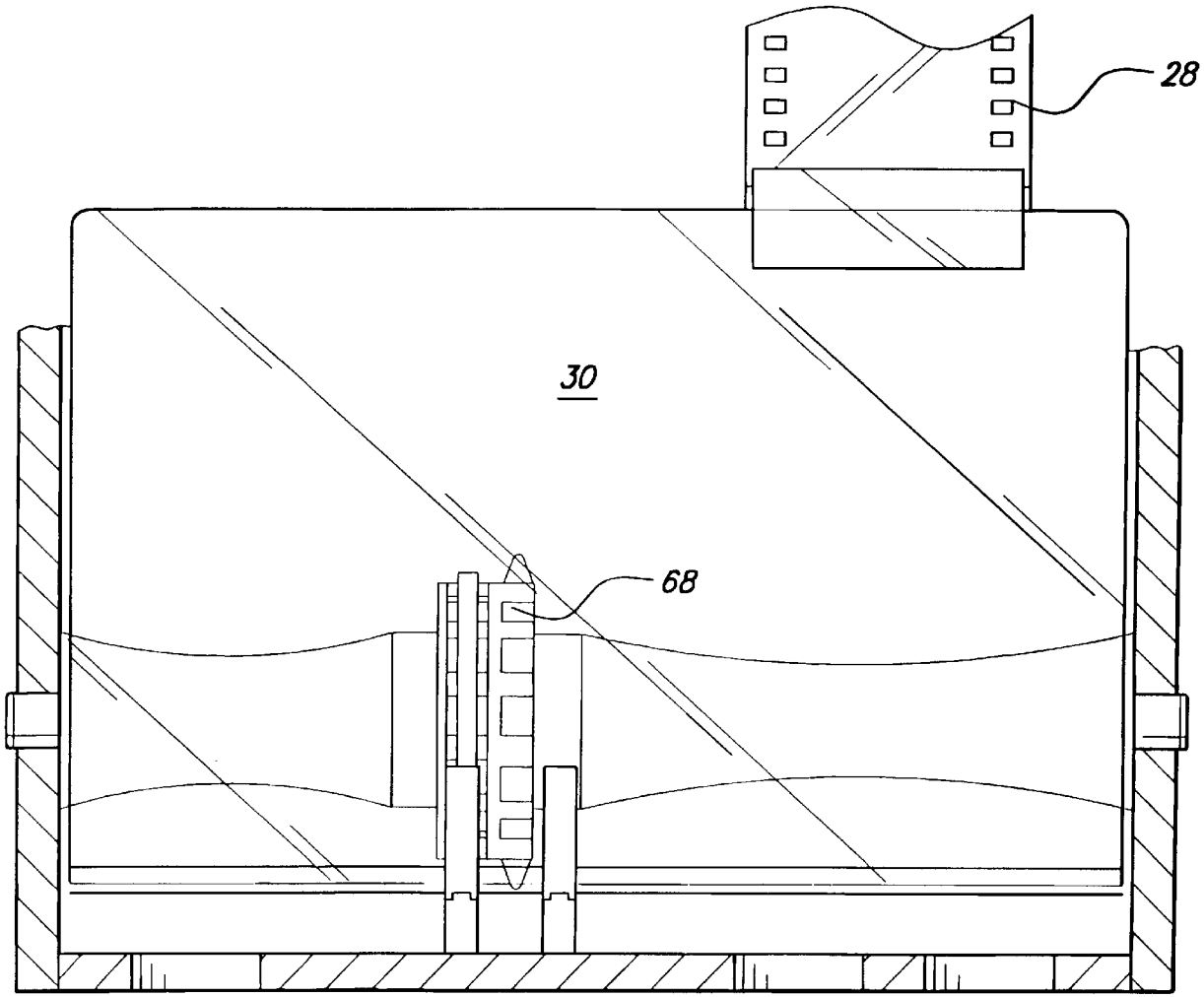
FIG. 10 is an elevation taken on lines 10—10 of FIG. 8.

The elongated film strip to be processed is shown at 28 in FIG. 2, temporarily attached by removable tape 29*a*, to a leader card 30. The film may be pulled from a storage cassette or cartridge 28*a* in response to endwise advancement of the card 30 through the processing apparatus. The leader card 30 is constructed of a thin flexible material such as a synthetic resin and contains an endwise series sequence of through openings 32, adapted to mesh with teeth on drive rotors, to be described, to advance the card, that pulls the film strip from the cassette, for processing in the apparatus. The leader card 30 of the preferred embodiment is approximately 9 inches long. Note that the film strip is offset laterally from the longitudinal row of openings 32 (shown in FIG. 10).

Figure 4:
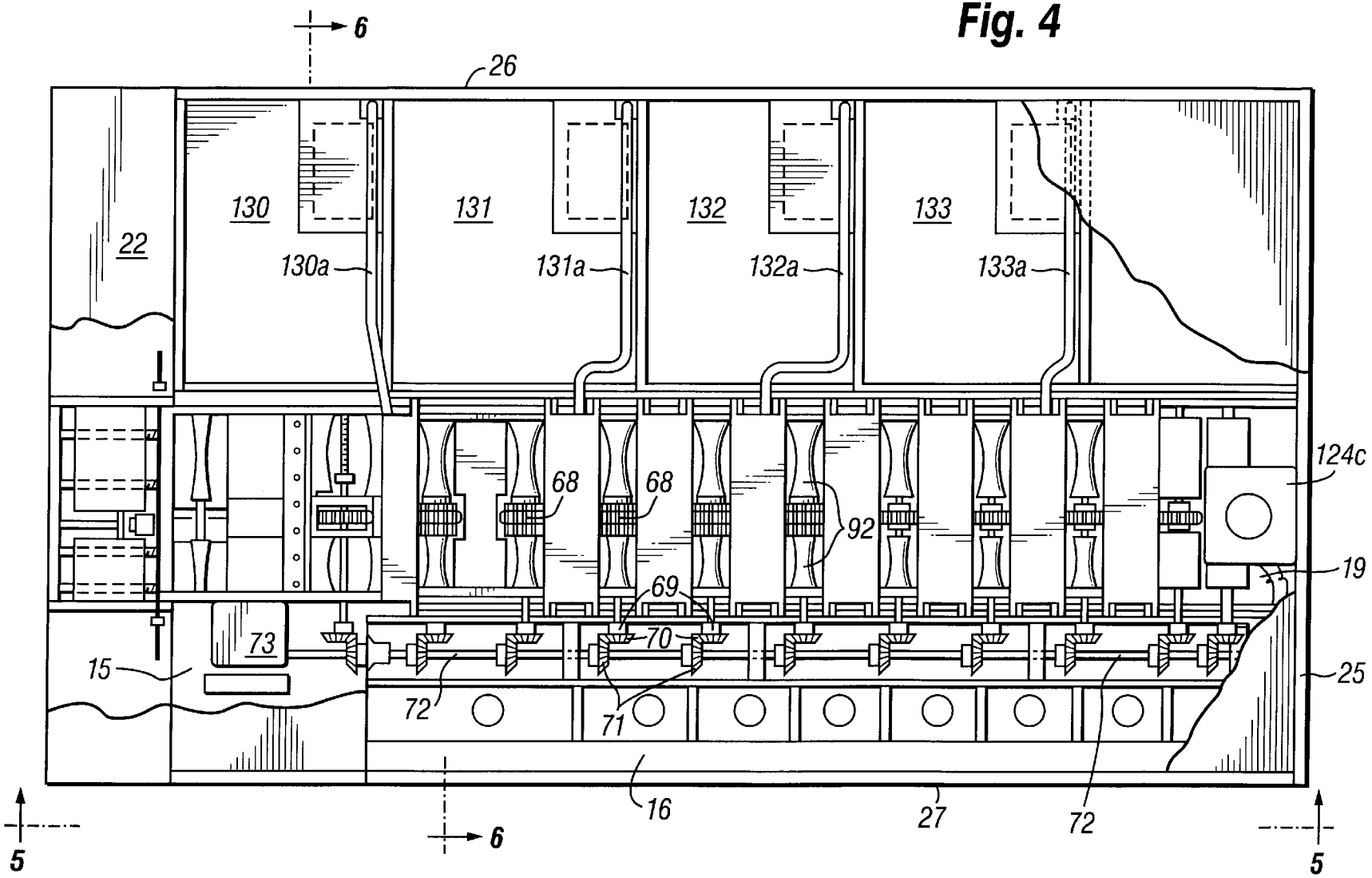
FIG. 4 is a top plan view showing the processing tanks, film drive means, and processing liquid replenishment tanks.

Although this apparatus is not limited to the C-41 process of development, FIGS. 3 and 4 illustrate this process as one example configuration. In FIGS. 3 and 4, the processing liquid receptacle or tanks 11 are shown sequentially at 11*a*–11*g*, and may contain processing liquids, the receptacles identified as follows for the C-41 example:

11*a*—color developer

11*b*—bleach

11*c*—fixer

11*d*—fixer

11*e*—stabilizer

11*f*—stabilizer

11*g*—stabilizer

The liquids in the successive or different tanks may vary according to the process chosen including, but not limited to the C-41, E-6 and Black and White processes.

Drive rotors and guides to advance and guide the leader card and film strips through the successive solutions are identified as follows:

31*a*—entrance guide roller which directs the card 30 toward the entrance sprocket

30*a*—entrance sprocket to advance leader card and film from the entrance area toward the processing tanks

33, 40, 42, 47, 52 & 58*a*—upper rotors which directly engage the leader card with sprocket teeth to drive the card downwardly into the processing solutions or drying zone

35, 38, 44, 49, 54 & 58*b*—lower rotors driven by timing belts engaged from upper rotors serve to direct the leader card upwardly. Furrow rollers (92) on a common shaft with the lower rotors serve to guide the film around the bottom turn guide as it is pulled upwardly by the leader card.

31—crossover rollers guide the film on its upper turn as it is pulled back downwardly by the leader card

40, 41, 46, 51, 56, 58, 60 & 62—crossover guides direct the leader card from upward to downward travel

36—upper turn guide in center of double rack to turn the leader card back downwardly while films are constrained by crossover rollers 31

57, 59 & 61—sprockets drive the leader card downwardly around lower furrow rollers and then upwardly towards the crossover guides in the shorter racks which are too small to incorporate both upper and lower rotors.

As the above discussion should make clear, the upper turn guide 36 works in conjunction with the upper rotor 33 and 40 and lower rotors 35 and 38 in the first treatment tank to reverse the direction of the filmstrip advance such that the upper rotor 33 advances the leader card 30 and attached film strip downwardly into the film processing liquid within said tank where the lower rotor 35 re-directs the leader card 30 such that it advances upwardly toward the cross-over film guide 36, the cross-over film guide 36 contacts the leader card and film strip before the leader card and film strip emerge from the film processing liquid in the tank and re-directs the leader card and film strip downwardly toward the second lower rotor assembly 38, which then re-directs the film strip and advances said film strip upwardly toward the second upper rotor 40 which advances the film strip upwardly, out of the film processing liquid.

The leader card and film then pass through drying zone 19, being guided and driven by rotors 58*a* and 58*b* upwardly and downwardly while exposed to hot drying air. Pinch rollers 63 and 64 drive the leader card and film out of the drying zone to the exit of the apparatus.

Upright walls of the succession of separate receptacles or tanks act as a support structure and allow the racks to be removed from the tanks 11 after the top cover 23 is lifted, via a handle or handles 23*a* and the upper crossover guides 32, 41, 46, 51, 56, 58, 60 and 62 are removed. The upper rotors, lower rotors and crossover rollers have their axles carried by racks within the receptacle. See for example axles 65 in FIG. 6 carried by upright walls 81 and 82 of a rack 83 that fits downwardly within receptacle or tank 11*a*. Similar racks are employed in the other receptacles or tanks. The racks have wall perforations as at 86 to pass process liquid or drying air into the rack interiors. Upper rotors have axles 66 supported by walls 81 and 82.

Figure 7:
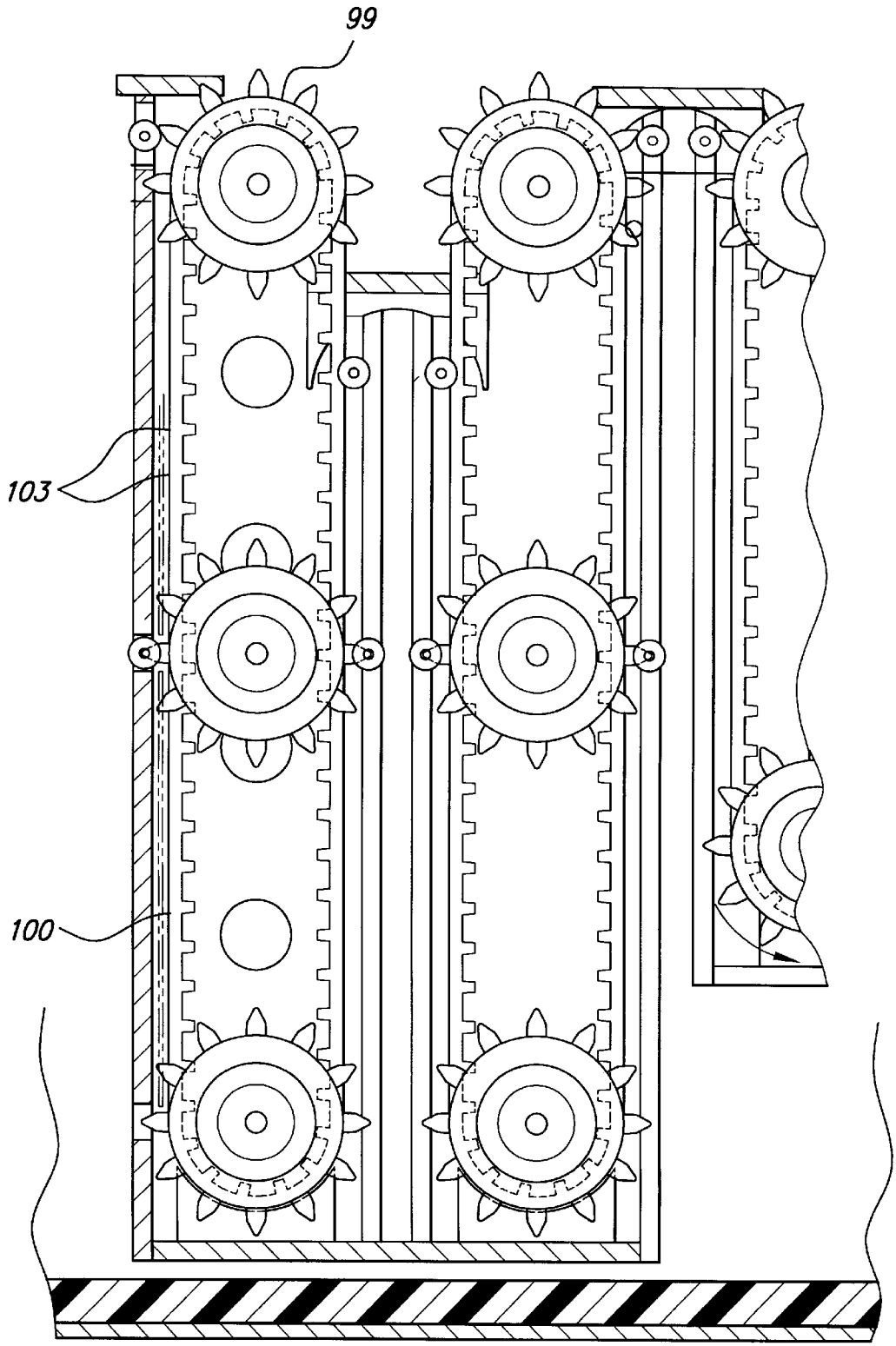
FIG. 7 is a fragmentary elevation taken on lines 7—7 of FIG. 6.

The upper rotors typically carry drive teeth 99 at one side, to engage timing belts 100 that entrain similar teeth 101 on the lower rotors for rotating the latter. The upper and lower rotors carry sprocket teeth 102 on the other side to engage the perforations 32 on the leader card 30 to advance the latter. In long racks, a middle rotor (35*a*, 38*a* and 58*a*) may be incorporated to engage and direct the leader card before it disengages from the upper or lower rotors. A small tensioning rotor 31*b* may be used to prevent the timing belt 100 from disengaging from the middle rotor. See FIGS. 7–9.

The upper rotors also have drive axles as at 69 carrying bevel gears 70 isolated from the interiors of the receptacles. Such gears are simultaneously driven by bevel gears 71 on a common drive shaft 72 rotated by an actuator 73, see FIG. 4. FIG. 3 shows the power supply 74 and step-down transformer 75 for the actuator motor, within the housing.

Figure 6:
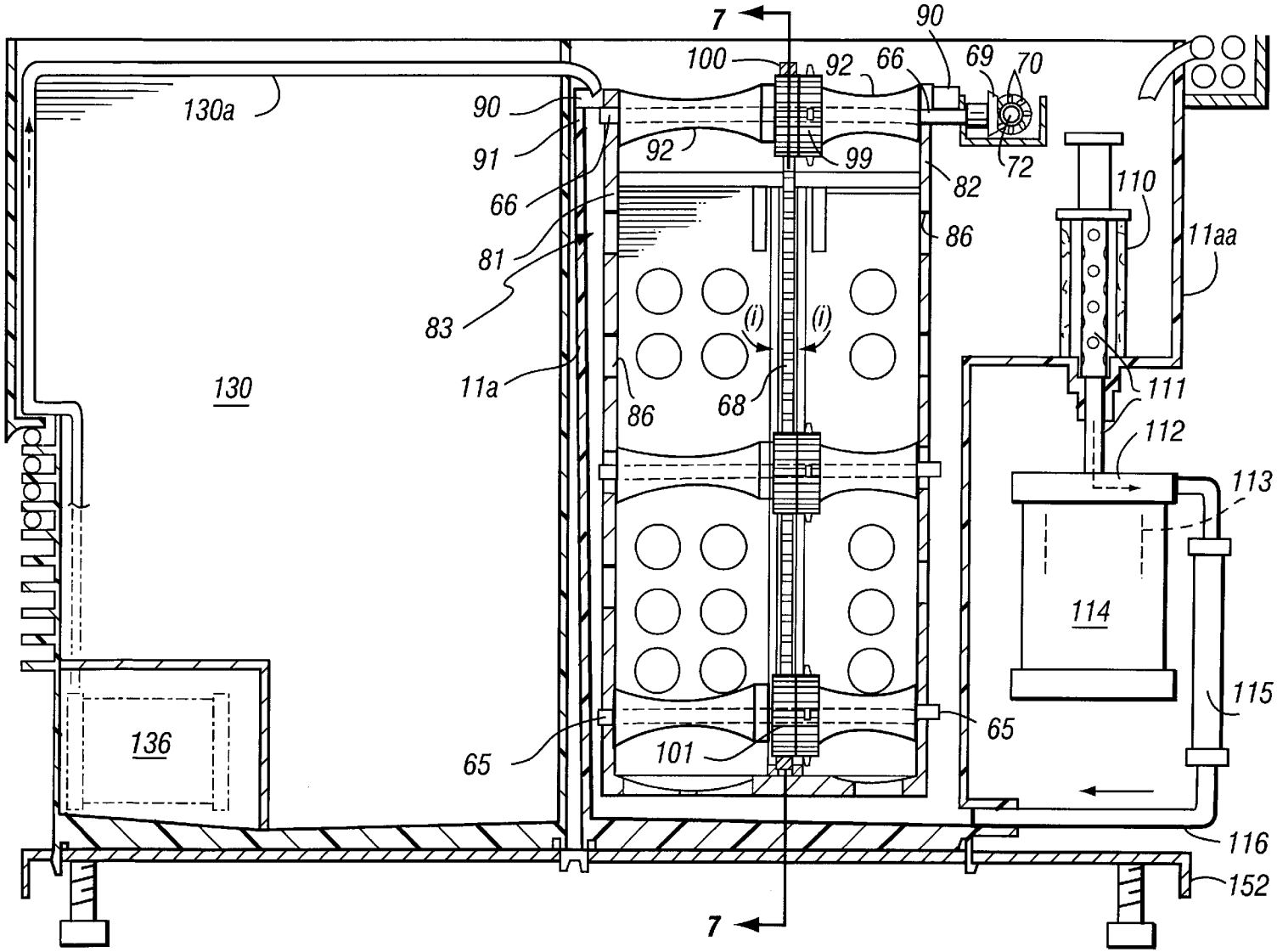
FIG. 6 is a section taken on lines 6—6 of FIG. 4.
Figure 8:
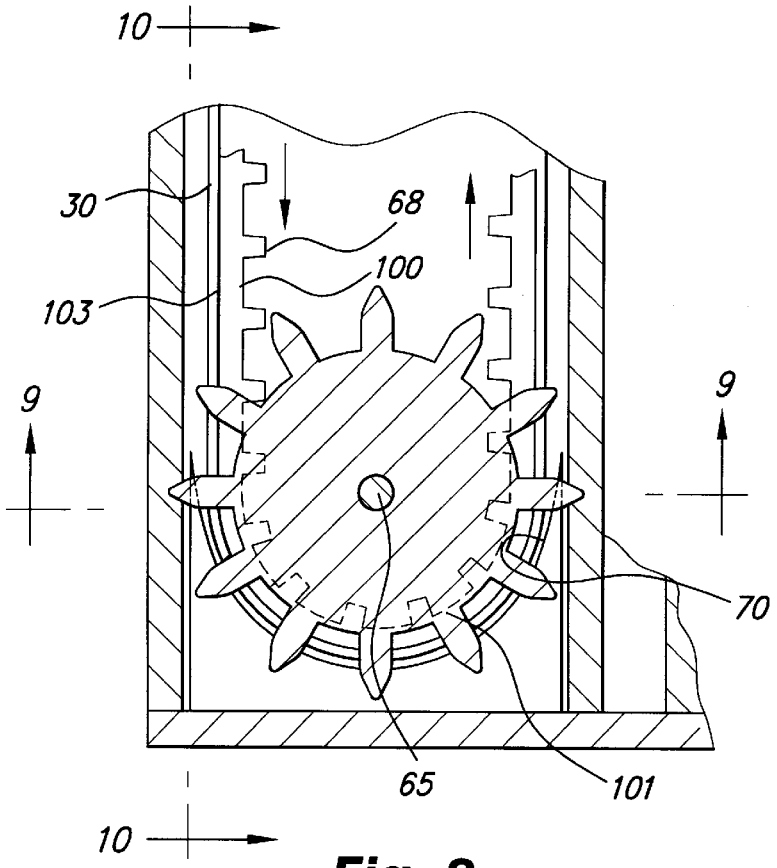
FIG. 8 is an enlarged fragmentary section showing the turning advancement path of the film leader card, at the bottom of a processing tank.
Figure 9:
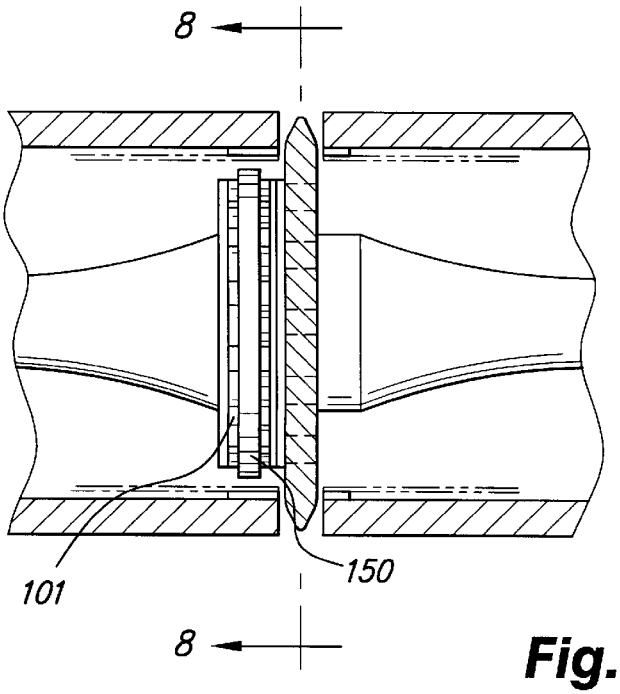
FIG. 9 is a section taken in plan on lines 9—9 of FIG. 8.

FIG. 6 shows upper rotor axles 66 and 69 carried by the rack 83, to be upwardly removable with the rack from the tank or receptacle. A flange 90 on the rack is supported by the receptacle at 91. FIG. 8 also shows upwardly concave guide surface 170 helping to turn the leader card and film back upwardly at the bottom of a rack.

Figure 12:
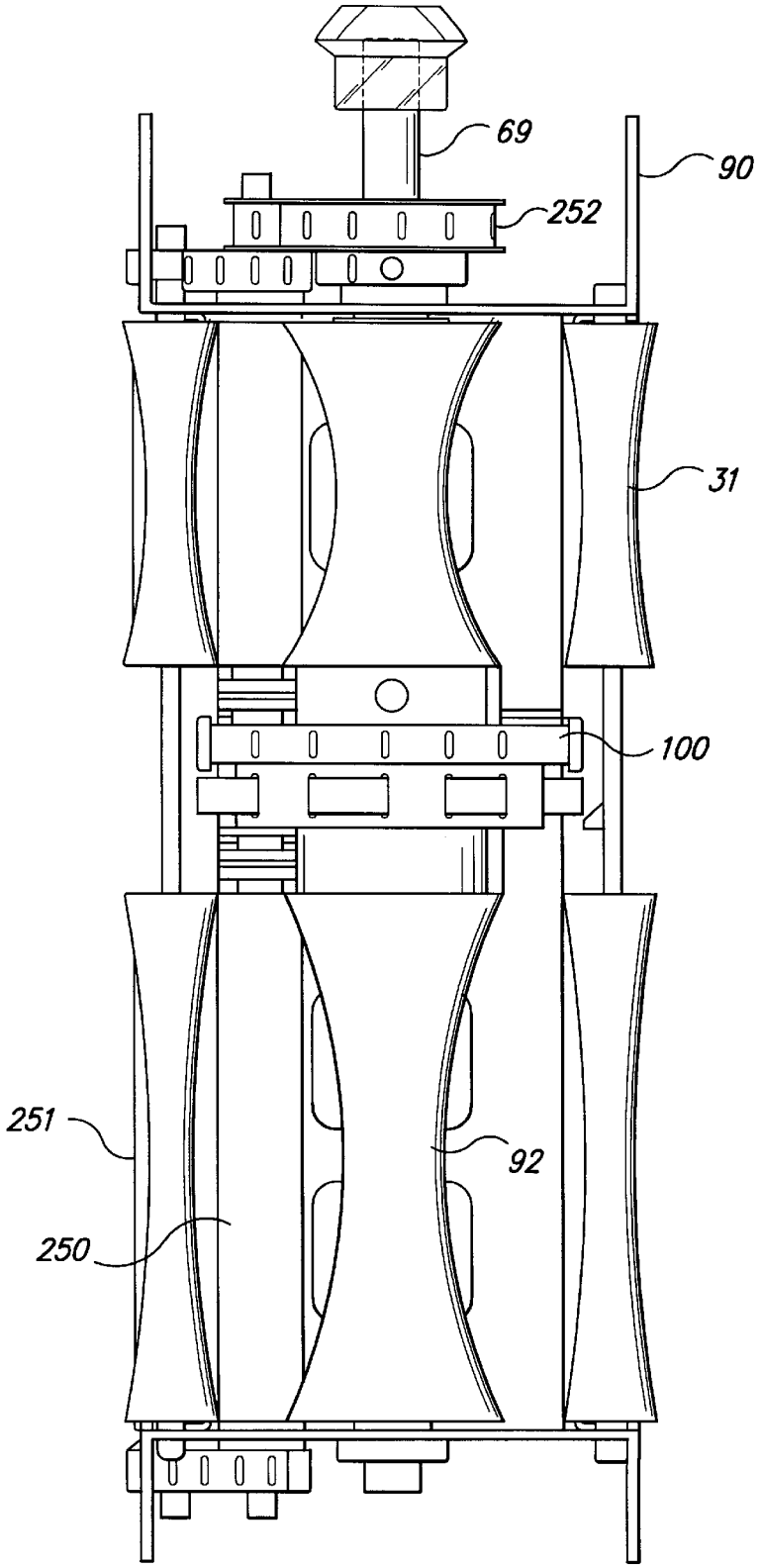
FIG. 12 is a schematic view of a rotor assembly which illustrates the squeegee rollers and associated drive apparatus of the present invention.

As best illustrated in FIG. 12, to reduce tank to tank transmission of treatment chemicals, the upper end of each rack includes matching, opposed pairs of squeegee rollers 250 and 251. These rollers contact the leader card and the film at the top of the rack as the leader card and film exits treatment tank 11*a*. The squeegee rollers 250 and 251 rotate in opposite directions through a single-sided drive belt 252 which draws power from the common drive shaft 72. The frictional contact of the squeegee rollers 250 and 251 on opposite sides of both the leader card 30 and the film strip 28 operates to remove excess treatment chemicals and thereby minimizes liquid loss from the treatment tanks and contamination caused by tank-to-tank transfer of treatment chemicals. Treatment tanks 11*b*, 11*d*, and 11*g* may also be outfitted with the squeegee roller system disclosed above.

Also provided are heating means for heating the liquids in the receptacles to selected temperature, and additional means for employing heat generated by said heating means for drying the film strip after it has passed through such liquids. The heating means typically includes heaters located outside the processing tanks, and the additional means (for drying film strip 28) advantageously includes an air flow passage to conduct flowing air in heat transfer relation with the heaters, pumps and control components and toward a film strip drying zone.

Further, the heaters may include electrical heating elements exposed to the air flow passage, with ducts provided for circulating processing solutions in heat transfer relation with the respective heating elements and toward the respective processing tanks, whereby liquid in each processing tank may be kept at its required elevated temperature.

In the preferred example shown in FIG. 6, the receptacle 11*a* has a laterally projecting upper portion 11*aa*, to which liquid is supplied from the interior of 11*a*. Such liquid in 11*aa* then circulates through a filter 110, and downwardly at 111 to a pump 112, as for example a centrifugal pump, driven as by a motor 113 in a housing 114. The liquid then passes through a heat exchanger 115, i.e. a heater acting to heat the liquid circulated downwardly and laterally at 116 to the lower interior of the receptacle 11*a*. Each of the receptacles 11*a*–11*g* as for the C-41 example may have a similar filter, pump and heater to heat the liquids in the various receptacles to selected processing temperatures controlled at 210. It will be noted that the heater or heaters 115, and the pump, are located in an air flow passage or passages, as referred to at 16 and 17 in FIG. 11, and located between the receptacles 11 and the housing side wall 27.

Figure 5:
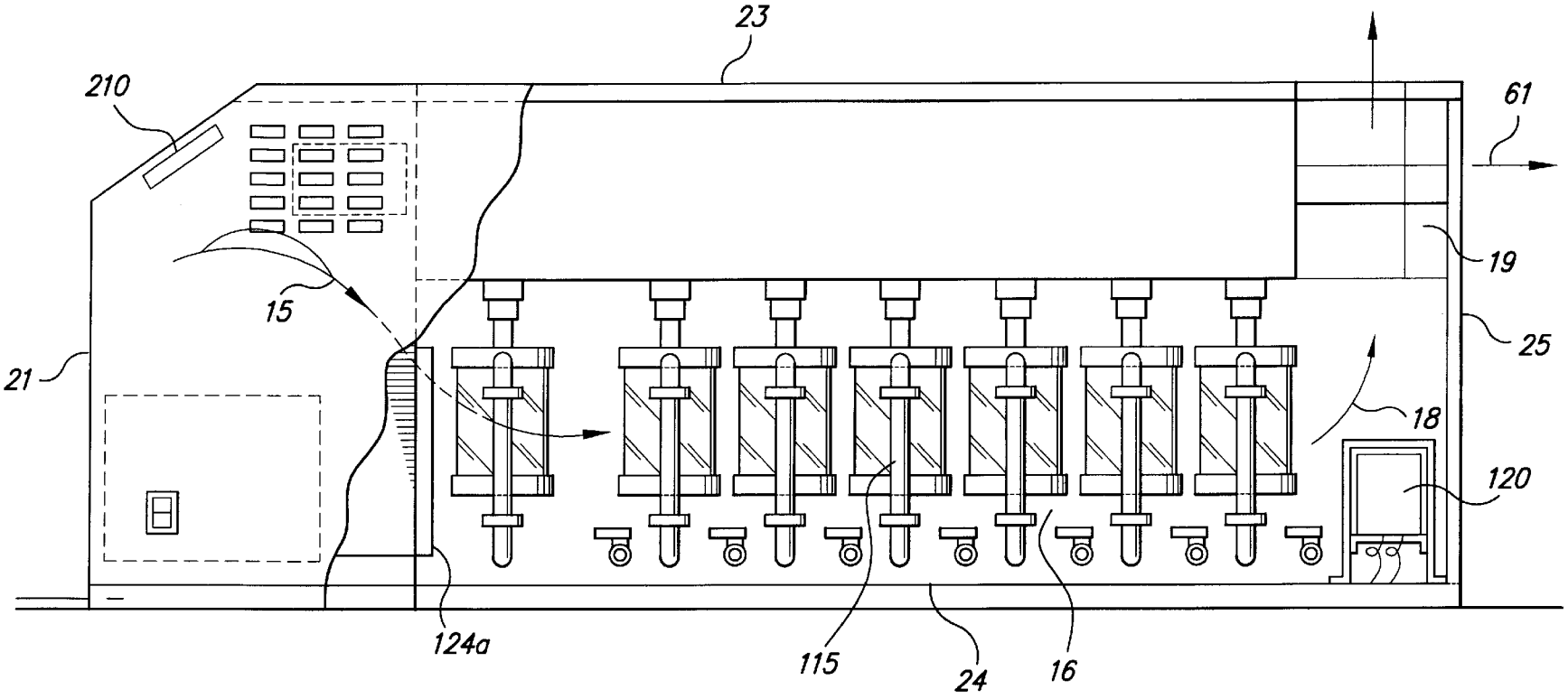
FIG. 5 is a side elevation taken on lines 5—5 of FIG. 4.

Waste heat generated by the liquids heaters and pumps is transferred to air flowing sidewardly of the receptacles, and within the housing, i.e. within passages 15–18, for use in drying the processed film strip 28. This heat transfer also serves to cool the pump motors 113 in passages 16 and 17. An auxiliary air heater 120 may be employed in an adjacent passage 18 as shown in FIGS. 3 and 5. Note that air flowing through passages 16 and 17 contacts the heaters 115 and pumps 114 in series sequence. Electrical control circuitry is located at 210 near the front end of the apparatus, to also transfer generated heat to the flowing air, at or near passage 15 for cooling the controls. Exhaust fans 124*b* and 124*c* are shown in FIG. 3, to draw film drying air through the air passages 15–18, and to exhaust 125. See also fan 124*a* helping to drive air over the motor 73 and to passages 16 and 17. If two film strips are attached to the leader card 30, at laterally opposite sides of the teeth drive card perforations 32, drying air may circulate between the two spaced film strips, for efficient drying.

Although the waste heat shed into the air in the waste heat air channel provides some degree of natural convective air movement, the preferred embodiment of the invention utilizes three fans to improve circulation within the air channel. Specifically, and as shown in FIGS. 3 and 4, a first fan 124*a* is provided in the air channel between the electronic equipment area and the circulation pump and solution heater area so as to draw air from the outside, through the air passages 15 and 16, in which the electronic equipment placed and into the air channel 17 in which the serial circulation pump and motors, 112 and 113 and solution heater 115 are placed. The waste heat shed by this electronic and mechanical equipment is thereby efficiently transferred to the air in the waste heat air channel and directed towards the drying zone 19. This circulation is aided by a second fan 124*b* which draws the pre-heated air from air passages 16 and 17, and circulates it through the dryer heater 120 which is disposed within air channel 18, to the drying zone 19. Finally, a third fan 124*c* is used to draw the hot, humid air from the drying zone 19 and vent it to the outside through the exhaust 125. This use of the recycled waste heat in the drying process increases the energy efficiently of the film processor and dramatically reduces overall energy consumption.

FIG. 4 shows process liquid auxiliary supply tanks 130–133 located laterally of receptacles 11*a*–11*d*, at the opposite side of the latter from the heaters. Liquid is delivered from tanks 130–133 to the receptacles 11*a*–11*d* via supply tubes 130*a*–133*a*, to make up for any loss of process liquid. FIG. 6 shows pumps as at 136 adjacent the tanks 130–133 to deliver supply liquid to the ducts 130*a*14 133*a*. Pumps 136 are controlled by control circuitry 210.

Legs 152 hold the bottom wall 24 above a support to allow leveling of the apparatus.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. Apparatus for processing and drying an elongated strip of photographic film, comprising:

a plurality of successive treatment tanks containing film processing liquids;

a film drive system which advances the film strip endwise through said treatment tanks to selected depths in said film processing liquids corresponding to required exposure times of the film to the film processing liquids, said film drive system having electronic control circuitry;

a heater system for drying the film strip in a drying zone;

a waste heat air flow passage which serves to convey waste heat generated by the film drive system electronic control circuitry to the drying zone.

2. The apparatus of claim 1 further including a solution heater which heats the film processing liquid in at least one treatment tank to a pre-selected operating temperature, said solution heater being exposed to said waste heat air flow passage such that waste heat generated by the solution heater is conveyed to the drying zone.

3. The apparatus of claim 2 further including a solution circulation pump which maintains the film processing liquid in at least one treatment tank at a pre-selected fluid level, said solution circulation pump being exposed to said waste heat air flow passage such that waste heat generated by said solution circulation pump is conveyed to the drying zone.

4. The apparatus of claim 2 further including at least one fan which is disposed to circulate air through said waste heat air passage towards said drying zone.

5. The apparatus of claim 3 further including at least one fan which is disposed to circulate air through said waste heat air passage towards said drying zone.

6. The apparatus of claim 2 further including at least one fan which is disposed so as to draw hot air from the drying zone and vent said air from the apparatus.

7. A method reducing energy consumption during processing of an elongated strip of photographic film using an integrated film processing apparatus comprising the steps of:

attaching the film strip to a film processing and drying drive system;

advancing the film strip endwise through a succession of treatment tanks containing film processing liquids wherein the film is advanced to selected depths in said film processing liquids corresponding to required exposure times of the film to the film processing liquids; and circulating air through a waste heat air channel defined within said film processing apparatus, across heat generating equipment utilized within said film processing apparatus, and into a film drying zone within said film processing apparatus.

* * * * *